US005452525A

United States Patent [19]

Miyauchi

[11] Patent Number: 5,452,525

[45] Date of Patent: Sep. 26, 1995

[54] SHOE INSOLE FOR ABSORBING HUMIDITY

[76] Inventor: Hideo Miyauchi, Tokyo Fil Tennis Club Bldg., No. 6-1, Niijuku 4-Chome, Katushika-Ku, Tokyo, Japan

[21] Appl. No.: 172,577

[22] Filed: Dec. 22, 1993

[30] Foreign Application Priority Data

Dec. 28, 1992 [JP] Japan ..... 4-092958 U

[51] Int. Cl.[6] ..... A43B 13/38

[52] U.S. Cl. ..... 36/44; 36/9 A; 36/84

[58] Field of Search ..... 36/44, 9 A, 84, 36/43, 25 R, 30 R

[56] References Cited

U.S. PATENT DOCUMENTS

| | | | |
|---|---|---|---|
| 3,600,717 | 8/1971 | McKeehan | 36/9 A |
| 4,099,342 | 7/1978 | Singh | 36/44 |
| 4,192,086 | 3/1980 | Sichak | 36/44 |
| 4,464,850 | 8/1984 | Ebert et al. | 36/44 |
| 4,709,490 | 12/1987 | Fottinger et al. | 36/44 |
| 5,154,960 | 10/1992 | Mucci et al. | 36/44 |

*Primary Examiner*—Paul T. Sewell
*Assistant Examiner*—Thomas P. Hilliard
*Attorney, Agent, or Firm*—Pearne, Gordon, McCoy & Granger

[57] ABSTRACT

A shoe insole comprising a layer for holding a shape of the insole and a hygroscopic multi-layer assembly including a ground pulp hygroscopic layer for absorbing humidity in an interior of a shoe in which the insole is used whereby the humidity is converted into water particle and a water absorbing polymer layer for absorbing the water particle.

8 Claims, 1 Drawing Sheet

SHOE INSOLE FOR ABSORBING HUMIDITY

BACKGROUND OF THE INVENTION

This invention relates to an insole for various shoes such as business shoes, sport shoes, ski boots, work shoes and the likes and more particularly an improvement on a disposal type shoe insole to be used for absorbing humidity in a shoe and to be disposed of only in a day.

Various kinds of shoe insoles have been used for keeping warm, deodorization or hygroscopicity as well as for fitting the shoes. Conventional shoe insoles used for absorbing humidity in order to prevent water-eczema from occuring comprise water absorbing material to directly absorb humidity occuring in the shoes due to user's perspiration.

In general, it is hard that the water absorbing material directly absorbs humidity and therefore has lower effectiveness of hygroscopicity. Furthermore, as the water absorbing material absorbs humidity, it swells so that it gets out of shape.

This disadvantagesouly causes the user to feel uncomfortable and also the shoes to be adversely affected.

In addition thereto, since the water absorbing material protrudes through a skin of the insole as it absorbs water, the protruded portion of the water absorbing material tends to contact the sole of user's foot, which causes the user to feel uncomfortable.

SUMMARY OF THE INVENTION

Accordingly, it is a principal object of the invention to provide a shoe insole adapted to have higher effectiveness of hygroscopicity and to be prevented from being deformed.

It is another object of the invention to provide a shoe insole adapted so that water absorbing material of the shoe insole never protrudes as water is absorbed whereby the sole of user's fool is prevented from uncomfortably contacting it.

In accordance with the present invention, there is provided a shoe insole comprising an insole shape holding layer and a water absorbing body having at least one hygroscopic multi-layer assembly including a ground pulp hygroscopic layer for absorbing humidity in an interior of a shoe in which said insole is used whereby the humidity is converted into water particle and a water absorbing polymer layer for absorbing said water particle.

The hygroscopic multi-layer preferably includes tissue paper layers between which the ground pulp hygroscopic layer is placed and also tissue paper layers between which the water absorbing polymer layer is placed.

A water impermeable layer may be preferably provided between the insole shape holding layer and the water absorbing body while a water permeable layer may be preferably provided on the upper face of the water absorbing layer.

With the hygroscopic multi-layer assembly including the ground pulp hygroscopic layer and the water absorbing polymer layer, the ground pulp hygroscopic layer absorbs humidity in the interior of a shoe in which the shoe insole is used and converts humidity into water particle and thereafter the water absorbing polymer layer absorbs the water particle from the ground pulp hygroscopic layer.

Thus, it should be noted that humidity is more effectively absorbed by the shoe insole compared with the conventional shoe insole, the water absorbing material of which directly absorbs the humidity.

It should be also noted that since after the humidity is absorbed by the ground pulp hygroscopic layer, it is absorbed by water absorbing polymer layer, the latter is deformed slowly, which allows the shoe insole to be kept enough intact for one day of use, and thereafter it is to be disposed of.

As the ground pulp hygroscopic layer and the water absorbing polymer layer are respectively placed between the upper and lower tissue paper layers, respectively, they never protrude even though they gel out of shape. Thus, it will be noted that the elements of the shoe insole never directly contact the user's foot sole, which enables the shoe insole to be comfortably used.

BRIEF DESCRIPTION OF THE DRAWINGS

The above and other objects and features of the invention will be apparent from the description of the embodiment of the invention taken along with the accompanying drawing in which.

DETAILED DESCRIPTION OF THE EMBODIMENT

Figure 1:
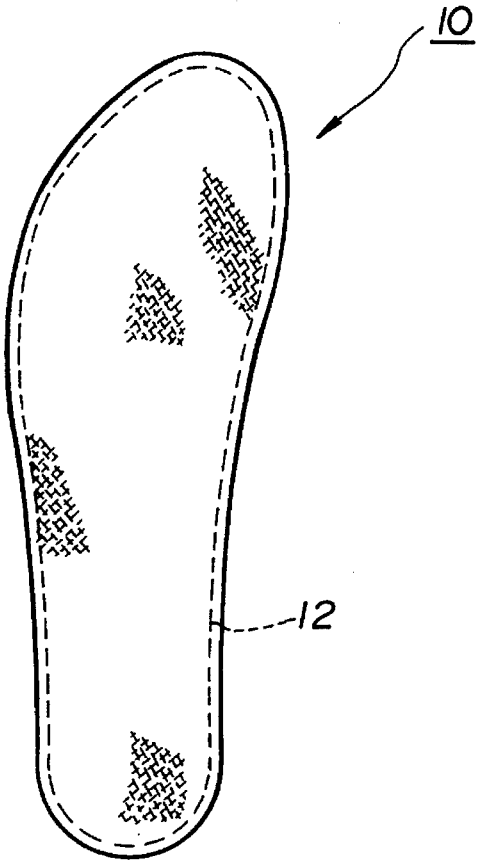
FIG. 1 is an upper view of a shoe insole constructed in accordance with the invention.
Figure 2:
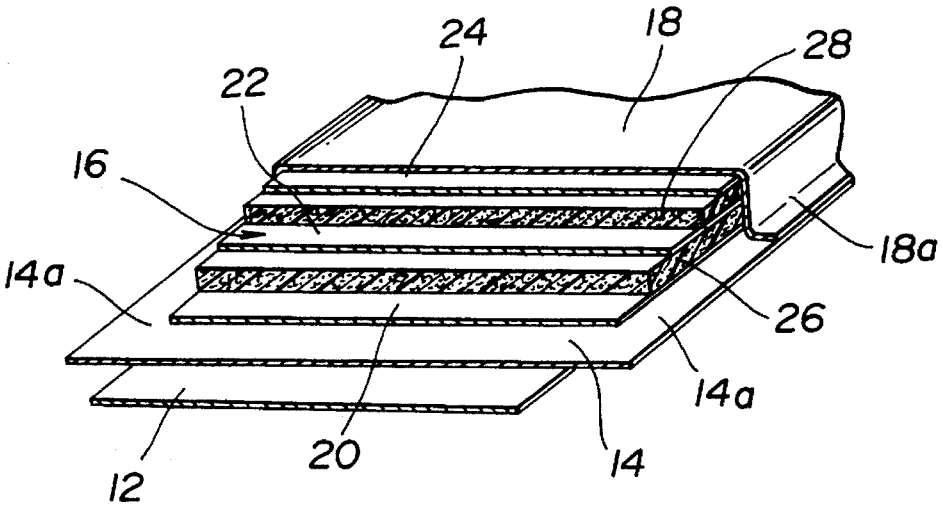
FIG. 2 is an enlarged perspective view of the shoe insole while the various layers are taken in cross section.

Referring now to FIGS. 1 and 2, there is shown a shoe insole 10 constructed in accordance with one embodiment of the invent, ion. As shown in FIG. 2, the shoe insole 10 comprises an insole shape holding layer 12 having a shape generally corresponding to a shape of an inner bottom of a shoe in which the shoe insole is to be used as shown in dotted lines in FIG. 1, a water absorbing body having hygroscopic multi-layer assembly 16 which will be described in more detail later, a water impermeable layer 14 provided between the insole shape holding layer 12 and the water absorbing body and a humidity permeable layer 18 provided on an upper face of the water absorbing body.

More particularly, the water impermeable layer 14 and the humidity permeable layer 18 are bonded at their peripheries to each other so that the hygroscopic multi-layer assembly 16 is wrapped or enclosed by them. Also, as shown in FIG. 2, the hygroscopic multi-layer assembly 16 preferably has the substantially same area as that of the insole shape holding layer 12.

The insole shape holding layer 12 may be formed of relatively thinner humidity-proofing and somewhat hard paper sheet. The insole shape holding layer 12 has a shape similar to that of an inner bottom of the shoe in which the shoe insole is to be used and an area slightly smaller than that of the shoe inner bottom. As shown in FIG. 2, the insole shape holding layer 12 has a periphery positioned along a periphery of the water impermeable layer 14, but away inside therefrom.

The water impermeable layer 14 may be formed of impermeable plastic film such as polyethylene film, for example, which is bonded by adhesives to the insole shape holding layer 12.

The humidity permeable layer 18 may be formed of humidity permeable material such as polypropylene in the form of porous non-woven fabric. The polypropylene non-woven fabric may be preferably dried enough.

As aforementioned, since the water impermeable layer 14 has an area larger than those of the insole shape holding layer 12 and the hygroscopic multi-layer assembly 16 while the humidity permeable layer 18 has also the substantially same area as that of the water impermeable layer 14, the water impermeable layer 14 and the humidity permeable layer 18 protrude at their peripheries away from the hygroscopic multi-layer assembly 16 outside thereof as indicated by the reference numerals 14*a* and 18*a*. The protruding peripheries 14*a* and 18*a* of the water impermeable layer 14 and the humidity permeable layer 18 are bonded by adhesives to each other so that they wrap the hydroscopic multi-layer assembly 16.

The hydroscopic multi-layer assembly 16 includes a ground pulp hygroscopic layer 28 for absorbing humidity in an interior of a shoe in which the shoe insole 10 is used whereby the humidity is converted into water particle and a water absorbing polymer layer 26 for absorbing the water particle from the ground pulp hygroscopic layer 28.

The hydroscopic multi-layer assembly 16 further includes three tissue paper layers 20, 22 and 24. The ground pulp hygroscopic layer 28 is placed between the tissue paper layers 22 and 24 while the water absorbing polymer layer 26 is placed between the tissue paper layers 20 and 22. As shown in FIG. 2, it should be noted that the water absorbing polymer layer 26 is essentially placed under the ground pulp hydroscopic layer 28. The ground pulp hydroscopic layer 28 may be in the form of a pad.

The water absorbing polymer layer 26 may be formed of bridged polyacryl-acid salt material in the form of particles which is commercially available under the tradename "ARASORB" from Arakawa Chemical Company, Japan or under the tradename "WONDERGEL" from Kao Company, Japan, for example. Otherwise, the water absorbing polymer layer 26 may be formed of hydrolysis material of acrylic resin in the form of fibers which is commercially available under the tradename "RANSEAL" from Nippon Exran Company, Japan, for example. It should be noted that the water absorbing polymer layer 26 may be formed of combination of the aforementioned the particles of bridged polyacryl-acid salt material and the fibers of hydrolysis material of acrylic resin.

The hydroscopic multi-layer assembly 16 occupies the substantial thickness of the whole shoe insole 10, but is relatively thinner and preferably a few millmeters thick, for example, so that the shoe insole 10 never damages the comfortableness with which the user wears the shoes.

The water absorbing polymer layer 26 and the ground pulp hydroscopic layer 28 of the hydrscopic multi-layer assembly 16 may be disposed in a uniform manner all over their area, but the water absorbing polymer layer 26 and the ground pulp hydroscopic layer 28 are disposed in larger quantities at portions of the shoe insole 10 corresponding to finger tips where much humidity tends to be concentrated than at remaining portions thereof.

The shoe insole 10 may be manufactured by laminating the insole shape holding layer 12, the water impermeable layer 14, the hydroscopic multi-layer assembly 16 and the humidity permeable layer 18 one upon another, thereafter heating and pressing in a hydraulic or mechanical press and cutting them to form the shoe insole of predetermined shape. In this case, the protruding peripheries 14*a* and 18*a* of the water impermeable layer 14 and the humidity permeable layer 18 are bonded to each other by adhesive which is previously placed between the layers 14 and 18, when the press presses them.

The shoe insole 10 is used while it is placed on an inner bottom of a shoe in the same manner as the conventional shoe insole, but it should be noted that the flexible peripheries 14*a* and 18*a* of the water impermeable layer 14 and the humidity permeable layer 18 protruding from the insole shape holding layer 12 and bonded to each other are flexibly bent along an instep inner portion of the shoe.

As humidity is accumulated in the shoe due to the user's perspiration, it passes through the humidity permeable layer 18 and is absorbed by the pad-like ground pulp hydrscopic layer 28 of the hygroscopic multi-layer assembly 16 to be converted into water particle.

Then, the water particle is absorbed by the water absorbing polymer layer 26 of the hygroscopic multi-layer assembly 16. It should be noted that such a system in which humidity is converted into water particle by the ground pulp hygroscopic layer 28 and thereafter the water particle is absorbed by the water absorbing polymer layer 26 causes more humidity to be absorbed than the conventional system in which humidity is directly absorbed by water absorbing material and as a result the effectivenes of hygroscopicity is more improved.

The tissue paper layers 20, 22 and 24 serve to separate the water absorbing polymer layer 26 and the ground pulp hygroscopic layer 28 so that the operation of converting humidity into water particle and the operation of absorbing the water particle are sequentially made and also serve to help laminating the respective layers 26 and 28 in a sequential manner. Thus, the tissue paper layers 20, 22 and 24 may be preferably placed between the water impermeable layer 14 and the water absorbing polymer layer 26, between the water absorbing polymer layer 26 and the ground pulp hygroscopic layer 28, and between the ground pulp hygroscopic layer and the humidity permeable layer 18, respectively in consideration of their function and manufacturing the shoe insole 10.

The water impermeable layer 14 also serves to prevent the insole shape holding layer 12 from being made wet because no water permeates through the water impermeable layer 14.

Since the humidity is absorbed by the ground pulp hygroscopic layer 28 and thereafter by the water absorbing polymer layer 26, the deformation of the water absorbing polymer layer 26 is delayed. This allows the shoe insole to be used for one day after which it; is disposed of.

If the hygroscopic multi-layer assembly 16 comprised only water absorbing polymer layers 26, then the latter would be deformed into beads earlier to have an evenness on the surface thereof. Otherwise, if the hygroscopic multi-layer assembly 16 comprised only ground pulp hygroscopic layers 28, then humidity would be absorbed and converted into water particle, which will cause the shape of the shoe insole to be not kept intact and be deformed. Thus, it will be noted that using only either of the water absorbing polymer layers and the ground pulp hygroscopic layers will never allow the shoe insole to be used even only in one day.

Since the water absorbing polymer layer 26 of the hygroscopic multy-layer 16 tends to get out of shape as it absorbs water, the shoe insole cannot be reused even though it is dried after its use. Thus, the shoe insole of the invention should be disposed of after it is used one day. If the shoe insole of the invention is reused, then the user will disadvantageously feel uncomfortable.

Although a single embodiment of the invention has been described and illustrated with reference to the accompanying drawing, it will be understood by those skilled in the art that it is by way of example, and that various changes and modifications may be made without departing from the spirit and scope of the invention, which is defined only to the appended claims.

What is claimed is;

1. A shoe insole adapted to be positioned along an inner bottom of a shoe for absorbing humidity within the shoe interior, said insole comprising a water absorbing body joined to a shape holding layer adapted to be placed along the inner bottom of the shoe, said water absorbing body including an outer humidity permeable layer cooperating with a water impermeable layer to enclose a hygroscopic multi-layer assembly, said multi-layer assembly including a ground pulp hygroscopic layer for absorbing humidity and converting it to water particles and a water absorbing polymer layer means disposed below the pulp layer for absorbing the water particles, said humidity permeable layer and water impermeable layer having overlying peripheral portions joined together by an adhesive to enclosed said hygroscopic multi-layer assembly in said water absorbing body.

2. A shoe insole as set forth in claim 1, wherein said hygroscopic multi-layer assembly further includes a tissue paper layer on each side of said ground pulp hygroscopic layer.

3. A shoe insole as set forth in claim 1, wherein said water absorbing polymer layer means is in the form of particles.

4. A shoe insole as set forth in claim 1, wherein said water absorbing polymer layer means is in the form of fibers.

5. A shoe insole as set forth in claim 1, wherein said water absorbing polymer layer means is in the form of a combination of polymer particles and fibers.

6. A shoe insole as set forth in claim 1, wherein said water impermeable layer is formed of plastic film.

7. A shoe insole as set forth in claim 1, wherein said humidity permeable layer is formed of plastic non-woven fabric.

8. A shoe insole as set forth in claim 1, wherein said insole has a thickness and said hygroscopic multi-layer assembly has a thickness substantially equal to said insole thickness.

* * * * *